United States Patent [19]

Holland

[11] 4,101,990

[45] Jul. 25, 1978

[54] ADJUSTABLE HEIGHT BED

[75] Inventor: John Anthony Holland, Osborne Park, Australia

[73] Assignee: Avion Australia Pty Ltd., Osborne Park, Australia

[21] Appl. No.: 759,651

[22] Filed: Jan. 13, 1977

Related U.S. Application Data

[63] Continuation of Ser. No. 594,494, Jul. 9, 1975, abandoned.

[30] Foreign Application Priority Data

| | | | |
|---|---|---|---|
| Jul. 12, 1974 | [AU] | Australia | PB8188 |
| Aug. 20, 1974 | [AU] | Australia | PB8595 |
| Nov. 7, 1974 | [AU] | Australia | 75147/74 |

[51] Int. Cl.[2] ..... A61G 07/10; A47C 20/04

[52] U.S. Cl. ..... 5/63; 5/66; 5/68

[58] Field of Search ..... 5/63–69

[56] References Cited

U.S. PATENT DOCUMENTS

| | | | |
|---|---|---|---|
| 3,015,113 | 1/1962 | Wallen | 5/63 |
| 3,478,372 | 11/1969 | Benoit et al. | 5/63 |
| 3,608,102 | 9/1971 | Goodman | 5/63 |
| 3,887,950 | 6/1975 | Wachsman | 5/63 |

FOREIGN PATENT DOCUMENTS

| | | | |
|---|---|---|---|
| 2,534,452 | 12/1976 | Fed. Rep. of Germany | 5/63 |

*Primary Examiner*—Casmir A. Nunberg
*Attorney, Agent, or Firm*—Haseltine, Lake & Waters

[57] ABSTRACT

A bed comprising a mattress supporting frame supported on two pair of legs, the lower end of each pair being provided with an extendable portion so that the height of the frame above the floor may be varied, an operating shaft associated with each pair of legs, each shaft being rotatably mounted on or adjacent the associated pair of legs, an arm fixed to and projecting radially from the operating shaft, the arm being connected to the extendable portion of the legs associated with the operating shaft by one or more connecting links so that when a turning force is applied to the operating shaft to effect rotation thereof the height of each of the pair of legs associated therewith is decreased or increased and the mattress supporting frame is lowered or raised.

5 Claims, 3 Drawing Figures

ADJUSTABLE HEIGHT BED

CROSS-RELATED APPLICATION

This application is a continuation of copending application Ser. No. 594,494 filed July 9, 1975, now abandoned.

This invention relates to an improved hospital bed and in particular to an improved raising and lowering mechanism for the same.

Accordingly the invention resides in a bed comprising a mattress supporting frame supported on two pairs of legs, the lower end of each pair being provided with an extendable portion so that the height of the frame above the floor may be varied, an operating shaft associated with each pair of legs, each shaft being rotatably mounted on or adjacent the associated pair of legs, an arm fixed to and projecting radially from the operating shaft, said arm being connected to the extendable portion of the legs associated with the operating shaft by one or more connecting links so that when a turning force is applied to the operating shaft to effect rotation thereof the height of each of the pair of legs associated therewith is decreased or increased and the mattress supporting frame is lowered or raised.

The invention will be more fully understood in the light of the following description of several specific embodiments. The description is made with reference to the accompanying drawings of which:

Figure 1:
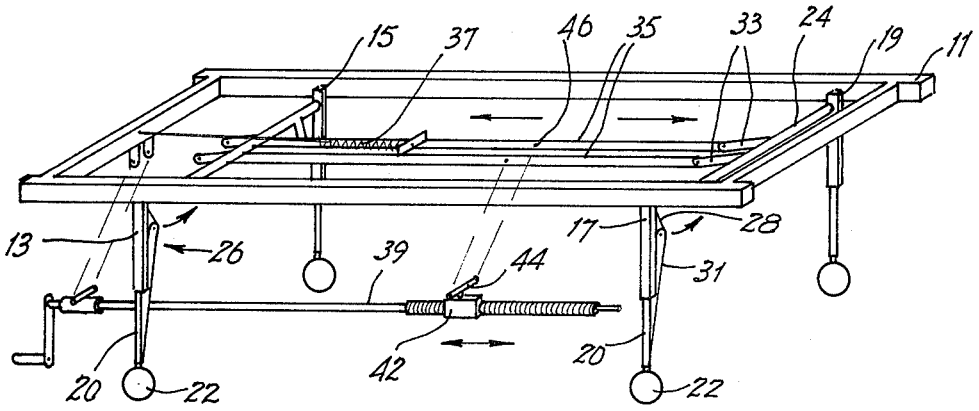
FIG. 1 is a perspective partly exploded view of one embodiment in the raised position.

The embodiment shown comprises a rectangular horizontal mattress supporting frame 11 having two pairs of transversely opposed legs 13 and 15, and 17 and 19. The legs according to the embodiment are formed of square cross-section tubing. Extending portions 20 are slidably mounted in each leg to facilitate the extension of each leg. The lower end of the extending portion 20 has castors 22 mounted thereon. An operating shaft 24 is transversely and rotatably mounted between each pair of legs. A knee joint 26 is provided between the operating shaft 24 and each extending portion 20. The knee joint comprises an arm 28 and connecting link 31 pivotally mounted together. The upper end of the arm 28 is rigidly mounted to the operating bar such that it extends radially therefrom while the lower end of the connecting link 31 is pivotally attached to the extendable portion 20 at its lower end. A pair of lever arms 33 are rigidly attached to the operating shaft 24 and extend radially therefrom. A pair of linkage bars 35 interconnects the lever arms 33 to provide for mutual movement of the lever arms of both operating shafts. A counterbalance spring 37 is mounted between the linkage bar and the mattress supporting frame 11. The drive means is shown in exploded form and comprises a rod 39 having a crank handle at one end and a screw threaded portion formed at the other end. The rod is rotatably supported upon the mattress supporting frame by a bearing member 40. A screw block or ball-screw race assembly or the like 42 is mounted upon the screw threaded formation on the rod 39. The block is also rotatably supported upon the linkage bars by peg members 44 which are engaged in holes 46 in the linkage bars 35.

To operate the mechanism of the bed, rotation of the crank handle of the rod 39 causes the screw block 42 to move longitudinally upon the rod resulting in a corresponding movement of the link bars 35. As a result of such movement and the linkage between the link bars 35 and the lever arms 33 the operating shafts 24 are caused to rotate and through the action of the knee joint 26 the extendable portions 20 of the legs are moved to either an extended or retracted position.

Counterbalance spring 37 between the link bars 35 and the upper bed frame 11 is such that it is in its most relaxed state when the bed is at its highest position. The tension of the spring is set to counterbalance at least a portion of the weight of the occupant of the bed. The the effect of such a spring is to eliminate the effort required to raise the bed with a patient lying upon it. While the embodiment shown in the drawings utilizes a counterbalance means in the form of an extension spring 37, it is possible to utilize any other suitable form of counterbalance such as a compression spring, gas spring or compressed air cylinder or like counterbalance means.

The embodiment described has several distinct advantages over those currently in use. Present hospital beds having a high-low characteristic appear to be quite complicated pieces of machinery and such a characteristic can often frighten a patient who may have been assigned to such a bed. The bed according to this embodiment has a quite uncomplicated appearance since most of the mechanism is located directly below the mattress supporting platform. Another problem with high-low beds currently in use is their tendancy for the telescoping legs to jam due to an unequal loading. Such problems are produced by the use of gear boxes and the like which introduce the existence of transverse and sometimes longitudinal rocking of the upper bed frame on the telescroping legs. Because of the direct drive to each leg there is negligable rocking between the upper bed frame and telescoping legs and as a result little likelihood of jamming as a result of unequal loading. The simplified structure of the bed greatly assists in its being capable of being completely cleaned for use in sterile situations. A further desirable feature of the bed includes the fact that no matter what height the bed is at the castors in the legs remain mounted vertical. Such is not the instance in many beds currently in use and this factor greatly affects the mobility of the bed when in some positions. The bed of the embodiment is fully mobile at whatever height it is set.

In addition, the use of the counterbalance extension greatly reduces the effort required in moving the bed up or down with the patient lying upon the bed. Many beds currently in use having a high-low characteristic are such that the patient must be off the bed during adjustment or more than one person is required during adjustment. The use of the counterbalance to bias the upper bed frame to the highest position (the tension being such that it balances at least a portion of the occupants weight) results in very little effort being required to adjust the height of the bed. As will be evident from the drawings, the horizontal disposition of the counterbalance spring and its connection between the frame and the linkage bars 35 connected to radial arms 33 provides for operation of the spring over a relatively short length in comparison with the adjustable movement of the bed whereby the biassing force can be substantially constant and independent of the height of the frame above the floor.

Figure 2:
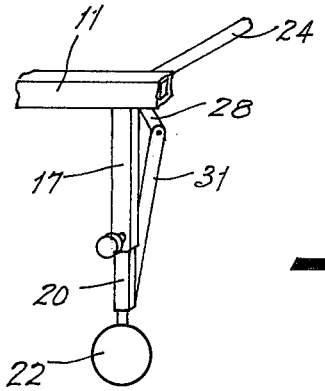
FIG. 2 is a perspective view of a leg of an embodiment of the invention.

According to another embodiment which is a variation of the embodiment described the screw threaded drive rod and screw block may be eliminated and the force of the counterbalance means set to as nearly as possible counterbalance the weight of the patient. According to the embodiment the legs are modified as shown in FIG. 2 as having a screw threaded locking stud 48 threadably engaged in the leg to frictionally engage the extendable portion 20. By the incorporation of handles around the bed frame the bed may be raised or lowered by unscrewing the locking studs 48 and applying a small lifting or pushing force to the bed frame.

The latter embodiment is envisaged as being intended for use on low cost beds which may rarely require their being moved from one level to another.

Figure 3:
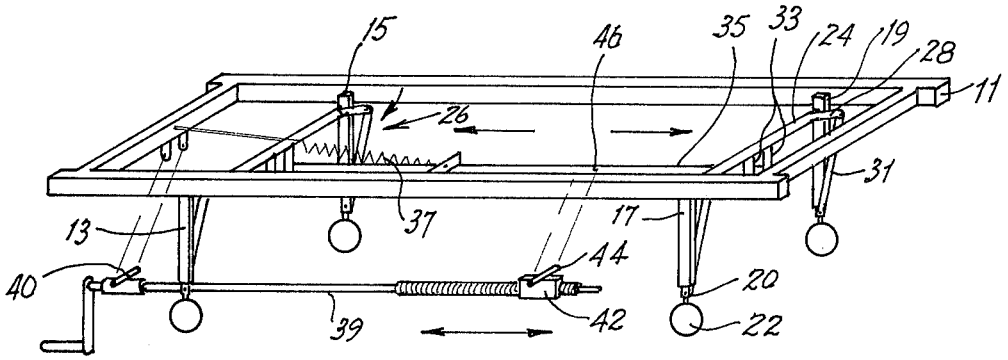
FIG. 3 is a perspective partly exploded view of the embodiment of FIG. 1 in the lowered position.

A further variation of the first embodiment involves the isolation of the drives for each pair of legs. Such isolation may be permanent by the use of two assemblies one for each pair of legs. Alternatively such isolation may be selective by means of a selective clutch type mechanism in the case of a drive as shown in FIGS. 1 and 3 such that one or the other may be disengaged from operation by the screw threaded rod. Such a feature is of use where it may be desired that the bed occupy a trendelenberg or reverse trendelenberg position.

According to another form of the invention only one knee joint may be used to link the operating shaft with the extendable leg portion. Such a linkage may comprise a support bar between the extendable portions of the legs. The knee joint is connected between the operating bar and support bar.

It should be appreciated that the scope of the invention cannot be limited to the particular features prescribed in the scope of the embodiments described.

I claim:

1. A bed comprising a mattress supporting frame; two pairs of legs each rigidly mounted on the frame and being independent of the others; each leg having an upper portion and a lower portion, the upper portion being mounted on the frame and telescopically engaged by the lower portion; an operating shaft associated with each pair of legs pivotably and transversely mounted in relation to the pair of legs; a pair of radial arms on each said operating shaft each being connected to the lower portion of one of said legs such that on application of a turning force on the operating shaft to effect turning thereof, the height of the frame above the floor can be varied; a drive means for selectively producing such turning, and counterbalance means mounted between the frame and the operating shafts to apply a rotary biassing force thereto, the biassing force applied to the operating shafts being sufficient to overcome the weight of the mattress-supporting frame and at least a portion of the weight of the occupant of the bed, said drive means comprising a screw threaded rod rotatably mounted on the mattress-supporting frame and means connecting the screw threaded rod and the operating shafts such that rotation of the screw threaded rod causes turning of the operating shafts, said means connecting the screw threaded rod and the operating shafts comprising a pair of linkage members for said shafts, and a pair of second radial arms mounted on each operating shaft and connected to a respective linkage member, said counterbalance means being substantially horizontally disposed and connected to said linkage members whereby the biassing force applied to each leg via said linkage members and radial arms is substantially constant and independent of the height of the frame above the floor.

2. A bed as claimed in claim 1 comprising locking means between each leg and its associated extendable portion.

3. A bed as claimed in claim 1 wherein said mattress-supporting frame is rectangular and said counterbalance means is disposed substantially in the plane of the frame.

4. A bed as claimed in claim 3 comprising a link connected to each said radial arm to form a knee joint at each leg.

5. A bed as claimed in claim 1 wherein said counterbalance means comprises a spring connected to the frame and the linkage members.

* * * * *

UNITED STATES PATENT AND TRADEMARK OFFICE

CERTIFICATE OF CORRECTION

PATENT NO. : 4,101,990

DATED : July 25, 1978

INVENTOR(S) : John Anthony HOLLAND

It is certified that error appears in the above-identified patent and that said Letters Patent are hereby corrected as shown below:

Please change name and address of assignee to read as follows:

--Avion Engineering Pty. Ltd.,
Belmont, Australia --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*